US006277036B1

(12) United States Patent
Hayashi et al.

(10) Patent No.: US 6,277,036 B1
(45) **Date of Patent: *Aug. 21, 2001**

(54) MULTI-PIECE SOLID GOLF BALL

(75) Inventors: Junji Hayashi; Hisashi Yamagishi; Hiroshi Higuchi; Yasumasa Shimizu, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/377,865

(22) Filed: Aug. 20, 1999

(30) Foreign Application Priority Data

Aug. 20, 1998 (JP) ..... 10-234464
Aug. 20, 1998 (JP) ..... 10-234481

(51) Int. Cl.[7] ..... A63B 37/06
(52) U.S. Cl. ..... 473/376
(58) Field of Search ..... 473/372, 373, 473/374, 376, 377, 378

(56) References Cited

U.S. PATENT DOCUMENTS 5,733,205 * 3/1998 Higuchi et al. ..... 473/373
5,743,816 4/1998 Ohsumi et al. .
5,772,531 6/1998 Ohsumi et al. .

FOREIGN PATENT DOCUMENTS 2 300 574 A 11/1996 (GB) ..... A63B/37/00
2 302 035 A 1/1997 (GB) ..... A63B/37/00
2 302 037 A 1/1997 (GB) ..... A63B/37/00
2 316 626 A 3/1998 (GB) ..... A63B/37/00
9-266959 10/1997 (JP) .
10-127818 5/1998 (JP) .
10-127819 5/1998 (JP) .

* cited by examiner

*Primary Examiner*—Mark S. Graham
*Assistant Examiner*—Raeann Gorden
(74) *Attorney, Agent, or Firm*—Sughrue, Mion, Zinn, Macpeak & Seas, PLLC

(57) ABSTRACT

In a multi-piece solid golf ball comprising a solid core, an enclosure layer, an intermediate layer, and a cover, the enclosure layer and the intermediate layer each have a Shore D hardness of 10–50, the hardness of the intermediate layer is lower than that of the enclosure layer, and the deflections under a load of 100 kg of the solid core, a first spherical body consisting of the solid core and the enclosure layer, a second spherical body consisting of the solid core, the enclosure layer and the intermediate layer, and the ball are controlled to fall in specific ranges. The cover is formed of a cover stock comprising an ionomer resin and an inorganic filler.

16 Claims, 1 Drawing Sheet

MULTI-PIECE SOLID GOLF BALL

This invention relates to a multi-piece solid golf ball comprising at least four layers, a solid core, an enclosure layer, an intermediate layer, and a cover and having high resilience, ease of control and a very soft pleasant feel.

BACKGROUND OF THE INVENTION

Many solid golf balls such as two-piece golf balls are known in the art. As compared with the wound golf balls, the solid golf balls have the advantage of an increased total flight distance on both driver and iron shots, because of a so-called straight liner trajectory and a low spin rate due to their structure, which allows for a long run. On the other hand, the solid golf balls are more difficult to control than the wound golf balls in that they do not stop short on the green because of low spin receptivity on iron shots.

Like flight distance, a pleasant feel when hit is essential for golf balls. The absence of a pleasant feel represents a substantial loss of commodity value. As compared with the solid golf balls, the wound golf balls have the structural characteristics ensuring a soft and pleasant feel.

On such solid golf balls, especially two-piece golf balls consisting of a core and a cover, attempts have been made to soften the ball structure in order to accomplish a soft feel upon impact. However, such attempts fail to fully meet the demand. By providing an intermediate layer between the core and the cover, three-piece solid golf balls were proposed. Although many proposals were made, it was still difficult to provide a golf ball having both the flight distance of two-piece solid golf balls and the feel of wound golf balls.

Recently, multi-piece solid golf balls having at least four layers were proposed (see JP-A 9-266959, 10-127818, and 10-127819). One solid golf ball proposed is of the four-layer structure in which a three-layer structure solid core consisting of an internal layer, an intermediate layer and an outer layer is enclosed with a cover. The ball is improved in hitting feel and control by providing a difference in hardness between the respective layers.

However, if the difference in hardness between two adjacent layers is reduced, there is achieved little improvement in hitting feel. If the difference in hardness between two adjacent layers is significant or if the selection of the thickness or material of the adjacent layers is inappropriate, the deflection or deformation upon impact becomes largely different between the adjacent layers. This causes an energy loss at the interface therebetween and thus detracts from resilience, resulting in a reduced flight distance. The durability of the ball against consecutive strikes is also lost. This tendency becomes outstanding particularly when two adjacent layers are formed of different materials which cannot be strongly joined.

SUMMARY OF THE INVENTION

An object of the invention is to provide a multi-piece solid golf ball comprising a solid core, an enclosure layer, an intermediate layer, and a cover which has ease of control and a very soft feel while maintaining the flight performance of solid golf balls.

The invention is directed to a multi-piece solid golf ball of at least four-layer structure comprising a solid core, an enclosure layer surrounding the core, an intermediate layer of at least one layer surrounding the enclosure layer, and a cover of at least one layer surrounding the intermediate layer. The inventor has found that by properly selecting the hardness, thickness and material of the respective layers, and the change rates of deflection under load of spherical bodies before and after the provision of a layer, the multi-piece solid golf ball can be improved in resilience and control and provided with a very soft, pleasant feel.

In a first aspect, the invention provides a multi-piece solid golf ball comprising a solid core, an enclosure layer around the core, an intermediate layer of at least one layer around the enclosure layer, and a cover of at least one layer around the intermediate layer, wherein the enclosure layer and the intermediate layer each have a Shore D hardness of 10 to 50, the Shore D hardness of the intermediate layer is lower than that of the enclosure layer. Provided that the solid core has a deflection A (mm) under an applied load of 100 kg, a first spherical body consisting of the solid core and the enclosure layer has a deflection B (mm) under an applied load of 100 kg, a second spherical body consisting of the solid core, the enclosure layer and the intermediate layer has a deflection C (mm) under an applied load of 100 kg, and the ball has a deflection D (mm) under an applied load of 100 kg, these defection values satisfy the relationship that A is from 2.5 to 7.0 mm, $0.85 \leqq B/A \leqq 1.15$, $0.85 \leqq C/B \leqq 1.15$, and $0.7 \leqq D/C \leqq 1.0$.

In a second aspect, the invention provides a multi-piece solid golf ball comprising a solid core, an enclosure layer around the core, an intermediate layer of at least one layer around the enclosure layer, and a cover of at least one layer around the intermediate layer, wherein the enclosure layer and the intermediate layer each have a Shore D hardness of 10 to 50, the Shore D hardness of the intermediate layer is lower than that of the enclosure layer, and the cover is formed of a cover stock comprising a thermoplastic resin as a base component and an inorganic filler. Provided that the solid core has a deflection A (mm) under an applied load of 100 kg, a first spherical body consisting of the solid core and the enclosure layer has a deflection B (mm) under an applied load of 100 kg, a second spherical body consisting of the solid core, the enclosure layer and the intermediate layer has a deflection C (mm) under an applied load of 100 kg, and the ball has a deflection D (mm) under an applied load of 100 kg, these defection values satisfy the relationship that A is from 2.5 to 7.0 mm, $0.85 \leqq B/A \leqq 1.15$, $0.85 \leqq C/B \leqq 1.15$, and $0.7 \leqq D/C \leqq 1.0$.

While the invention relates to a multi-piece solid golf ball comprising a solid core, an enclosure layer around the core, an intermediate layer of at least one layer around the enclosure layer, and a cover of at least one layer around the intermediate layer, the first requirement of the invention is that the deflection or deformation A (mm) under an applied load of 100 kg of the solid core is 2.5 to 7.0 mm, the deflection B (mm) under an applied load of 100 kg of the first spherical body consisting of solid core+enclosure layer, the deflection C (mm) under an applied load of 100 kg of the second spherical body consisting of solid core+enclosure layer+intermediate layer, and the deflection D (mm) under an applied load of 100 kg of the ball are selected so as to satisfy the relationship: $0.85 \leqq B/A \leqq 1.15$, $0.85 \leqq C/B \leqq 1.15$, and $0.7 \leqq D/C \leqq 1.0$. That is, the change rates of deflection under load of spherical bodies before and after the provision of a layer (that are represented by B/A, C/B and D/C) can be set approximate to 1. This minimizes the energy loss at the interface between adjacent layers upon impact and thus restrains the resilience from lowering.

The second requirement is that the enclosure layer and the intermediate layer each have a Shore D hardness of 10 to 50, and the Shore D hardness of the intermediate layer is lower than that of the enclosure layer. This imparts a very soft and pleasant feel to the ball upon putting and approach shots which entails only a small amount of deflection. Additionally, the ball becomes susceptible to spin and easy to control. The third (optional) requirement is that the enclosure layer and the intermediate layer are formed mainly of thermoplastic resins of the same type. This improves the bond between the enclosure layer and the intermediate layer and contributes to resilience. These choices cooperate synergistically, achieving a multi-piece solid golf ball which has significantly improved flight performance and control and gives a very soft and pleasant feel.

In the second aspect, the cover is formed of a cover stock comprising a thermoplastic resin as a base component and an inorganic filler. Owing to the reinforcing effect of the filler, the ball is-outstandingly improved in durability against consecutive strikes.

BRIEF DESCRIPTION OF THE DRAWINGS

The only FIGURE.

DESCRIPTION OF THE PREFERRED EMBODIMENTS

Figure 1:
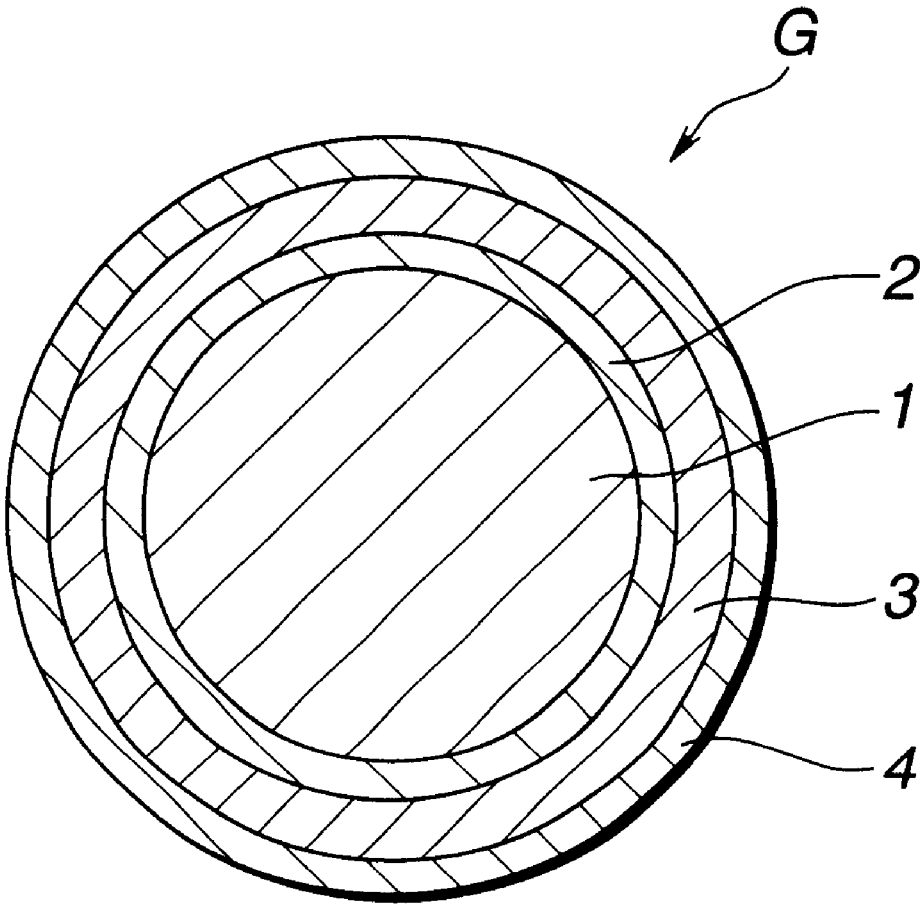
FIG. 1 is a cross-sectional view of a multi-piece solid golf ball according to one embodiment of the invention.

Referring to FIG. 1, a multi-piece solid golf ball G according to the invention is schematically illustrated as comprising a solid core 1, an enclosure layer 2 surrounding the core 1, an intermediate layer 3 of at least one layer surrounding the enclosure layer 2, and a cover 4 of at least one layer surrounding the intermediate layer 3.

The solid core may be formed of a rubber composition primarily comprising a base rubber which is based on polybutadiene rubber, polyisoprene rubber, natural rubber or silicone rubber. Polybutadiene rubber is preferred especially for improved resilience. The preferred polybutadiene rubber is cis-1,4-polybutadiene containing at least 40% cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 10 to 40 parts by weight per 100 parts by weight of the base rubber. A vulcanizing agent such as dicumyl peroxide may also be blended in the rubber composition, preferably in an amount of about 0.1 to 5 parts by weight per 100 parts by weight of the base rubber. In the rubber composition, an antioxidant and a specific gravity adjusting filler such as zinc oxide or barium sulfate may be blended. The amount of filler blended is 0 to about 130 parts by weight per 100 parts by weight of the base rubber.

One preferred formulation of the solid core-forming rubber composition is given below.

| | Parts by weight |
|---|---|
| Cis-1,4-polybutadiene | 100 |
| Zinc oxide | 0 to 50 |
| Zinc acrylate | 10 to 40 |
| Barium sulfate | 0 to 50 |
| Peroxide | 0.1 to 5.0 |
| Antioxidant | appropriate |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

Preferably the solid core has a diameter of 25.7 to 37.7 mm, more preferably 28 to 37 mm.

The core should have a deflection A (mm) under an applied load of 100 kg of 2.5 to 7.0 mm, preferably 2.8 to 6.8 mm, and more preferably 3.0 to 6.5 mm. With a core deflection of less than 2.5 mm, the feel of the ball upon driver shots (entailing a large amount of deformation) would become hard. With a core deflection of more than 7.0 mm, the resilience becomes too low to provide flight performance.

The core is usually formed to a single layer structure from one material although it may also be formed to a multilayer structure of two or more layers of different materials.

According to the invention, the enclosure layer 2 is formed around the core 1 (to form the first spherical body). The enclosure layer is composed mainly of a thermoplastic resin, examples of which include ionomer resins, polyester elastomers, polyamide elastomers, styrene elastomers, polyurethane elastomers, olefin elastomers and mixtures thereof. Of these, the thermoplastic polyester elastomers and polyurethane elastomers are preferred since they provide good resilience at the desired hardness. Use may be made of commercially available elastomers such as "Hytrel" from Toray-Dupont K.K., "Pandex" from Dai-Nippon Ink & Chemicals K.K., and "Premaloy" from Mitsubishi Chemical K.K.

To the enclosure layer composition, there may be added antioxidants and dispersants such as metal soaps, if necessary. The enclosure layer may be formed from plural layers of different materials.

Any desired method may be used in forming the enclosure layer around the core. Conventional injection or compression molding may be employed.

The enclosure layer preferably has a thickness of 0.5 to 4.0 mm, more preferably 0.7 to 3.5 mm and a Shore D hardness of 10 to 50, more preferably 15 to 47.

The first spherical body consisting of the solid core and the enclosure layer has a deflection B (mm) under an applied load of 100 kg, which is preferably 2.3 to 7.0 mm, more preferably 2.5 to 6.5 mm.

The intermediate layer 3 of at least one layer, preferably one or two layers is formed around the enclosure layer 2 (to form the second spherical body). Preferably the intermediate layer is composed mainly of a thermoplastic resin of the same type as the enclosure layer. When the enclosure layer and the intermediate layer are made of materials of the same type, they can be firmly joined, leading to improvements in durability and resilience. To the intermediate layer composition, there may be added UV absorbers, antioxidants and dispersants such as metal soaps, if necessary.

Any desired method may be used in forming the intermediate layer around the enclosure layer. Conventional injection or compression molding may be employed.

The intermediate layer preferably has a thickness of 0.5 to 4.0 mm, more preferably 0.7 to 3.5 mm. The thickness of the enclosure layer and the intermediate layer combined is preferably 2.0 to 5.0 mm, more preferably 2.0 to 4.5 mm. If the total thickness of enclosure and intermediate layers is less than 2.0 mm, there would be achieved only a little improvement in feel. If the total thickness is more than 5.0 mm, resilience would be lost.

The intermediate layer should have a Shore D hardness of 10 to 50, preferably 15 to 47. Where the intermediate layer consists of plural sub-layers, each sub-layer have a Shore D hardness in this range. The Shore D hardness of the intermediate layer should be lower than that of the enclosure layer. The hardness difference therebetween is preferably 3 to 30 Shore D units. If the Shore D hardness of the intermediate layer is higher than that of the enclosure layer, the ball would give a hard feel upon putting and approach shots (entailing a small amount of deformation) and become less easy to control due to reduced spin receptivity.

The second spherical body consisting of the solid core, the enclosure layer and the intermediate layer has a deflection C (mm) under an applied load of 100 kg, which is preferably 2.3 to 6.5 mm, more preferably 2.5 to 6.0 mm.

According to the invention, the enclosure layer and the intermediate layer, especially the intermediate layer disposed immediately inside the cover is made soft whereby the ball will give a very soft and pleasant feel upon putting and approach shots (entailing a small amount of deformation) and become easy to control due to appropriate spin receptivity upon approach shots.

The cover is made of a cover stock based on a conventional thermoplastic resin. Examples of the thermoplastic resin include ionomer resins, polyester elastomers, polyamide elastomers, styrene elastomers, polyurethane elastomers, olefin elastomers and mixtures thereof. Cover stocks based on ionomer resins are especially preferred. The ionomer resins are commercially available under the trade name of "Himilan" from Mitsui-Dupont Polychemical K.K. and "Surlyn" from Dupont. To the cover stock, there may be added titanium dioxide for coloring purpose, and if necessary, UV absorbers, antioxidants and dispersants such as metal soaps.

The cover is formed of at least one layer, preferably one or two layers. Any desired method may be used in forming the cover around the intermediate layer. Conventional injection or compression molding may be employed.

The cover preferably has a thickness of 1.0 to 3.5 mm, more preferably 1.0 to 3.0 mm and a Shore D hardness of 48 to 68, more preferably 50 to 65.

A spherical body having the cover formed around the intermediate layer, that is, the ball has a deflection D (mm) under an applied load of 100 kg, which is preferably 2.3 to 6.0 mm, more preferably 2.5 to 5.5 mm.

According to the invention, an appropriate amount of an inorganic filler is preferably added to the cover stock. The preferred cover stock contains 100 parts by weight of the resin component and 5 to 50 parts, more preferably 10 to 45 parts by weight of the inorganic filler. Less than 5 parts of the filler would provide little reinforcement whereas more than 50 parts of the filler would adversely affect dispersion and resilience.

The inorganic filler blended herein generally has a mean particle size of 0.01 to 100 $\mu$m, preferably 0.1 to 10 $\mu$m, and more preferably 0.1 to 1.0 $\mu$m. Outside the range, larger or smaller filler particles would be difficult to disperse, failing to achieve the objects of the invention. The inorganic filler preferably has a specific gravity of up to 4.8. When loaded with an inorganic filler having a specific gravity of more than 4.8, the cover itself becomes heavy, which is sometimes impractical for golf balls whose overall weight is prescribed by the Rules of Golf. Examples of the inorganic filler include barium sulfate, titanium dioxide, and calcium carbonate. They may be used alone or in admixture of two or more. Barium sulfate is most preferable.

The cover stock loaded with the inorganic filler should preferably have a specific gravity of 1.0 to 1.5, more preferably 1.05 to 1.45.

According to the invention, the change rates of deflection under 100-kg load of spherical bodies before and after the provision of a layer, that are represented by B/A, C/B and D/C are set approximate to 1.

Provided that the solid core has a deflection A (mm) under an applied load of 100 kg, the first spherical body consisting of solid core+enclosure layer has a deflection B (mm) under an applied load of 100 kg, the second spherical body consisting of solid core+enclosure layer+intermediate layer has a deflection C (mm) under an applied load of 100 kg, and the ball as a whole has a deflection D (mm) under an applied load of 100 kg, these defection values satisfy the following relationship:

$0.85 \leqq B/A \leqq 1.15$, preferably $0.87 \leqq B/A \leqq 1.13$, $0.85 \leqq C/B \leqq 1.15$, preferably $0.87 \leqq C/B \leqq 1.13$, and $0.75 \leqq D/C \leqq 1.0$, preferably $0.72 \leqq D/C \leqq 0.98$.

If the change rates of deflection under load of the respective spherical bodies before and after the provision of a layer are outside the above range, the deflection or deformation upon impact becomes largely different between the adjacent layers, which invites an energy loss at the interface therebetween and detracts from resilience, failing to increase the flight distance.

Since the material, hardness, and thickness of the respective layers, and the change rates of deflection of the respective spherical bodies before and after the provision of a layer are properly selected as described above so as to construct a minimized energy loss ball structure, the multi-piece solid golf ball of the invention adz exhibits favorable flight performance by virtue of improved resilience and gives a very soft, pleasant feel both upon hitting to a large extent of deformation (with a driver) and upon hitting to a small extent of deformation (with a putter).

The golf ball of the invention is provided on its surface with a multiplicity of dimples. Typically the ball surface is subject to various finish treatments including stamping and paint coating. The golf ball must have a diameter of not less than 42.67 mm and a weight of not greater than 45.93 grams in accordance with the Rules of Golf.

EXAMPLE

Examples of the invention are given below by way of illustration and not by way of limitation.

Examples 1–4 & Comparative Examples 1–3

Core-forming rubber compositions of the formulation shown in Table 1 were mixed in a kneader and molded and vulcanized in a core mold at a temperature of 155° C. for about 15 minutes, forming solid cores.

Around the cores, the enclosure layer, intermediate layer and cover were formed by injection molding the corresponding materials of the formulation shown in Table 1, respectively, obtaining solid golf balls of four-layer structure in Examples 1–4 and Comparative Example 3. It is noted that Comparative Example 1 is a two-piece golf ball consisting of the core and the cover (lacking the enclosure and intermediate layers) and Comparative Example 2 is a three-piece golf ball lacking the enclosure layer.

The golf balls were examined for several properties by the following tests. The results are shown in Table 2. It is understood that the hardness A of the solid core, the hardness B of the spherical body of core+enclosure layer, the hardness C of the spherical body of core+enclosure layer+intermediate layer, and the hardness D of the ball were measured whenever the corresponding layer was formed.

Solid Core Hardness A

The hardness A of the solid core was represented by a deflection (mm) of the core under a load of 100 kg.

First Spherical Body Hardness B

The hardness B of the spherical body of core+enclosure layer was represented by a deflection (mm) of the body under a load of 100 kg.

Second Spherical Body Hardness C

The hardness C of the spherical body of core+enclosure layer+intermediate layer was represented by a deflection (mm) of the body under a load of 100 kg.

Ball Hardness D

The hardness D of the ball was represented by a deflection (mm) of the ball under a load of 100 kg.

Flight Performance

A swing robot (by Miyamae K.K.) was equipped with a driver (PRO 230 Titan, loft angle 100, by Bridgestone Sports Co., Ltd.). The ball was struck with the driver at a head speed of 45 m/sec (HS 45), and the carry and total distance were measured.

Spin

By means of the swing robot, the ball was struck with a sand wedge (SW) at a head speed of 20 m/sec (HS 20). The spin of the ball was measured.

Feel

Five professional golfers actually hit the ball with a driver and putter and evaluated according to the following criterion.

◎: very soft
○: soft
Δ: ordinary
×: hard

TABLE 1

| | composition (parts by weight) | | | | | | |
|---|---|---|---|---|---|---|---|
| | E1 | E2 | E3 | E4 | CE1 | CE2 | CE3 |
| Layer structure | 4L | 4L | 4L | 4L | 2L | 3L | 4L |
| Solid core | | | | | | | |
| Cis-1,4-polybutadiene | 100 | 100 | 100 | 100 | 100 | 100 | 100 |
| Zinc acrylate | 26.6 | 20.5 | 25.8 | 20.7 | 27.0 | 25.0 | 10.4 |
| Dicumyl peroxide | 0.9 | 0.9 | 0.9 | 0.9 | 0.9 | 0.9 | 0.9 |
| Antioxidant | 0.2 | 0.2 | 0.2 | 0.2 | 0.2 | 0.2 | 0.2 |
| Zinc oxide | 5.0 | 5.0 | 5.0 | 5.0 | 5.0 | 26.0 | 5.0 |
| Barium sulfate | 38.4 | 25.2 | 25.5 | 21.7 | 17.7 | 0.0 | 62.3 |
| Enclosure layer | | | | | | | |
| Hytrel 3078 | 100 | | | | | | |
| Hytrel 4701 | | 100 | | | | | |
| Hytrel 4001 | | | 100 | | | | |
| Pandex EX7890 | | | | 100 | | | |
| Pebax 3533 | | | | | | | 100 |
| Intermediate layer | | | | | | | |
| Hytrel 3078 | 60 | 100 | 100 | 100 | | | |
| Premaloy A1500 | 40 | | | | | | |
| Hytrel 4001 | | | | | | 100 | |
| Cis-1,4-polybutadiene | | | | | | | 100 |
| Zinc acrylate | | | | | | | 30.8 |
| Dicumyl peroxide | | | | | | | 0.9 |
| Antioxidant | | | | | | | 0.2 |
| Zinc oxide | | | | | | | 5.0 |
| Barium sulfate | | | | | | | 3.37 |
| Cover | | | | | | | |
| Himilan 1601 | 50 | 50 | | 50 | | | |
| Himiian 1557 | 50 | 50 | | 50 | | | |
| Himilan 1605 | | | | | 50 | 50 | 50 |
| Himilan 1706 | | | 60 | | 50 | 50 | 50 |
| Surlyn 8120 | | | 40 | | | | |
| Titanium dioxide | 5.6 | 5.6 | 5.6 | 5.6 | 5.6 | 5.6 | 5.6 |

Hytrel: the trade name of thermoplastic polyester elastomer by Toray-Dupont K.K.

Pandex: the trade name of polyurethane elastomer by Dai-Nippon Ink & Chemicals K.K.

Pebax: the trade name of polyamide elastomer by Atochem

Premaloy: the trade name of polyester elastomer-base polymer alloy by Mitsubishi Chemical K.K.

Himilan: the trade name of ionomer resin by Mitsui-Dupont Polychemical K.K.

Surlyn: the trade name of ionomer resin by Dupont

TABLE 2

| | | E1 | E2 | E3 | E4 | CE1 | CE2 | CE3 |
|---|---|---|---|---|---|---|---|---|
| Core | Outer diameter (mm) | 30.7 | 32.7 | 32.7 | 32.7 | 38.5 | 35.2 | 24.2 |
| | Hardness A (mm) | 3.4 | 5.0 | 3.7 | 5.0 | 3.2 | 3.8 | 7.0 |
| Enclosure | Thickness (mm) | 1.5 | 1.5 | 1.5 | 1.5 | | | 1.5 |
| layer | Shore D hardness | 30 | 47 | 40 | 40 | | | 35 |
| | Hardness B (mm) | 3.5 | 4.8 | 3.6 | 4.9 | | | 7.0 |
| Hardness ratio B/A | | 1.03 | 0.96 | 0.98 | 0.98 | | | 1.00 |
| Intermediate | Thickness (mm) | 1.5 | 1.5 | 1.5 | 1.5 | | 1.7 | 5.5 |
| layer | Shore D hardness | 25 | 30 | 30 | 30 | | 40 | 55 |
| | Hardness C (mm) | 3.5 | 4.6 | 3.7 | 4.8 | | 3.7 | 4.0 |
| Hardness ratio C/B | | 1.00 | 0.96 | 1.02 | 0.98 | | 0.97 | 0.57 |
| Cover | Thickness (mm) | 3.0 | 2.0 | 2.0 | 2.0 | 2.1 | 2.1 | 2.3 |
| | Shore D hardness | 59 | 63 | 56 | 63 | 63 | 63 | 63 |
| Ball | Hardness D (mm) | 3.1 | 3.8 | 3.4 | 4.0 | 2.6 | 2.8 | 2.8 |
| | Weight (g) | 45.3 | 45.3 | 45.3 | 45.3 | 45.3 | 45.3 | 45.3 |
| | Diameter (mm) | 42.7 | 42.7 | 42.7 | 42.7 | 42.7 | 42.7 | 42.7 |
| Hardness ratio D/C | | 0.89 | 0.83 | 0.92 | 0.83 | 0.81 | 0.76 | 0.70 |
| Flight | Carry (m) | 210.5 | 209.3 | 210.0 | 209.2 | 208.5 | 207.2 | 203.0 |
| performance | Total (m) | 223.2 | 223.0 | 222.3 | 222.5 | 221.7 | 220.1 | 216.1 |
| @HS45 | | | | | | | | |
| SW spin (rpm) | | 5550 | 5300 | 5830 | 5280 | 4620 | 4830 | 4580 |
| Feel | Driver | ◎ | ◎ | ◎ | ◎ | X | Δ | ○ |
| | Putter | ◎ | ◎ | ◎ | ◎ | X | Δ | X |

As is evident from Table 2, the ball of Comparative Example 1 which is a conventional two-piece solid golf ball is inferior since it provides a low spin rate despite a relatively satisfactory distance, and gives a hard feel when hit with either a driver or a putter.

The ball of Comparative Example 2 which is a three-piece solid golf ball as described in JP-A 9-313643 is inferior since it is somewhat poor in spin and distance and gives a somewhat hard feel when hit with either a driver or a putter.

The ball of Comparative Example 3 which is a four-piece solid golf ball as described in JP-A 10-127819 travels a shorter distance because the hardness and thickness of the respective layers are not adequate so that an energy loss is induced at the interface between adjacent layers. Additionally, the spin when hit with a sand wedge is low. The ball gives a hard feel upon hitting to a small extent of deformation.

In contrast, the balls of Examples 1 to 4, due to their structure capable of avoiding an energy loss, are highly resilient, travel a longer distance, and give a very soft pleasant feel when hit with either a driver or a putter.

Since the intermediate layer is very soft, the ball is spin susceptible and easy to control with a sand wedge.

Examples 5–8

Core-forming rubber compositions of the formulation shown in Table 3 were mixed in a kneader and molded and vulcanized in a core mold at a temperature of 155° C. for about 15 minutes, forming solid cores.

Around the cores, the enclosure layer, intermediate layer and cover were formed by injection molding the corresponding materials of the formulation shown in Table 3, respectively, obtaining solid golf balls of four-layer structure in Examples 5–8.

The golf balls were examined for several properties by the same tests as in Example 1. Additionally, the durability of the balls was examined as follows.

Durability

Using a swing robot (by Miyamae K.K.), the ball was repeatedly struck 300 times with a driver (PRO 230 Titan, loft angle 100, Bridgestone Sports Co., Ltd.) at a head speed of 45 m/sec. For each ball, 10 ball samples were tested and the number of cracked samples was reported.

The results are shown in Table 4 together with the results of Comparative Examples 1 to 3.

TABLE 3

| | composition (parts by weight) | | | | | | |
|---|---|---|---|---|---|---|---|
| | E5 | E6 | E7 | E8 | CE1 | CE2 | CE3 |
| Layer structure | 4L | 4L | 4L | 4L | 2L | 3L | 4L |
| Solid core | | | | | | | |
| Cis-1,4-polybutadiene | 100 | 100 | 100 | 100 | 100 | 100 | 100 |
| Zinc acrylate | 27.5 | 21.3 | 26.7 | 21.5 | 27.0 | 25.0 | 10.4 |
| Dicumyl peroxide | 0.9 | 0.9 | 0.9 | 0.9 | 0.9 | 0.9 | 0.9 |
| Antioxidant | 0.2 | 0.2 | 0.2 | 0.2 | 0.2 | 0.2 | 0.2 |
| Zinc oxide | 5.0 | 5.0 | 5.0 | 5.0 | 5.0 | 26.0 | 5.0 |
| Barium sulfate | 15.3 | 6.5 | 4.6 | 3.4 | 17.7 | 0.0 | 62.3 |
| Enclosure layer | | | | | | | |
| Hytrel 3078 | 100 | | | | | | |
| Hytrel 4701 | | 100 | | | | | |
| Hytrel 4001 | | | 100 | | | | |
| Pandex EX7890 | | | | 100 | | | |
| Pebax 3533 | | | | | | | 100 |
| Intermediate layer | | | | | | | |
| Hytrel 3078 | 60 | 100 | 100 | 100 | | | |
| Premaloy A1500 | 40 | | | | | | |
| Hytrel 4001 | | | | | | 100 | |
| Cis-1,4-polybutadiene | | | | | | | 100 |
| Zinc acrylate | | | | | | | 30.8 |
| Dicumyl peroxide | | | | | | | 0.9 |
| Antioxidant | | | | | | | 0.2 |
| Zinc oxide | | | | | | | 5.0 |
| Barium sulfate | | | | | | | 3.37 |
| Cover | | | | | | | |
| Himilan 1601 | | 50 | | 50 | | | |
| Himilan 1557 | | 50 | 60 | 50 | | | |
| Himilan 1605 | | | | | 50 | 50 | 50 |
| Himilan 1706 | 60 | | | | 50 | 50 | 50 |
| Surlyn 8120 | 40 | | 40 | | | | |
| Barium sulfate | 17 | 28 | 28 | 28 | | | |
| Titanium dioxide | 5.6 | 5.6 | 5.6 | 5.6 | 5.6 | 5.6 | 5.6 |

Hytrel: the trade name of thermoplastic polyester elastomer by Toray-Dupont K.K.

Pandex: the trade name of polyurethane elastomer by Dai-Nippon Ink & Chemicals K.K.

Pebax: the trade name of polyamide elastomer by Atochem

Premaloy: the trade name of polyester elastomer-base polymer alloy by Mitsubishi Chemical K.K.

Himilan: the trade name of ionomer resin by Mitsui-Dupont Polychemical K.K.

Surlyn: the trade name of ionomer resin by Dupont

TABLE 4

| | | E5 | E6 | E7 | E8 | CE1 | CE2 | CE3 |
|---|---|---|---|---|---|---|---|---|
| Core | Outer diameter (mm) | 30.7 | 32.7 | 32.7 | 32.7 | 38.5 | 35.2 | 24.2 |
| | Hardness A (mm) | 3.4 | 5.0 | 3.7 | 5.0 | 3.2 | 3.8 | 7.0 |
| Enclosure | Thickness (mm) | 1.5 | 1.5 | 1.5 | 1.5 | | | 1.5 |
| layer | Shore D hardness | 30 | 47 | 40 | 40 | | | 35 |
| | Hardness B (mm) | 3.5 | 4.8 | 3.7 | 4.9 | | | 7.0 |
| Hardness ratio B/A | | 1.03 | 0.96 | 1.00 | 0.98 | | | 1.00 |
| Intermediate | Thickness (mm) | 1.5 | 1.5 | 1.5 | 1.5 | | 1.7 | 5.5 |
| layer | Shore D hardness | 25 | 30 | 30 | 30 | | 40 | 55 |
| | Hardness C (mm) | 3.5 | 4.6 | 3.7 | 4.8 | | 3.7 | 4.0 |
| Hardness ratio C/B | | 1.00 | 0.96 | 1.00 | 0.98 | | 0.97 | 0.57 |
| Cover | Thickness (mm) | 3.0 | 2.0 | 2.0 | 2.0 | 2.1 | 2.1 | 2.3 |
| | Shore D hardness | 58 | 62 | 56 | 62 | 63 | 63 | 63 |
| | Specific gravity | 1.10 | 1.17 | 1.17 | 1.17 | 0.98 | 0.98 | 0.98 |
| Ball | Hardness D (mm) | 3.1 | 3.8 | 3.4 | 4.0 | 2.6 | 2.8 | 2.8 |
| | Weight (g) | 42.7 | 42.7 | 42.7 | 42.7 | 42.7 | 42.7 | 42.7 |
| | Diameter (mm) | 45.3 | 45.3 | 45.3 | 45.3 | 45.3 | 45.3 | 45.3 |
| Hardness ratio D/C | | 0.89 | 0.83 | 0.92 | 0.83 | 0.81 | 0.76 | 0.70 |
| Flight | Carry (m) | 210.3 | 209.3 | 210.0 | 209.0 | 208.5 | 207.2 | 203.0 |
| performance | Total (m) | 222.7 | 223.5 | 222.5 | 223.0 | 221.7 | 220.1 | 216.1 |
| @HS45 | | | | | | | | |
| SW spin (rpm) | | 5510 | 5280 | 5810 | 5330 | 4620 | 4831 | 4580 |
| Durability | | 0/10 | 0/10 | 0/10 | 1/10 | 1/10 | 6/10 | 10/10 |
| Feel | Driver | ◎ | ◎ | ◎ | ◎ | X | Δ | ○ |
| | Putter | ◎ | ◎ | ◎ | ◎ | X | Δ | X |

As is evident from Table 4, the balls of Examples 5 to 8, due to their structure capable of avoiding an energy loss, are highly resilient, travel a longer distance, and give a very soft pleasant feel when hit with either a driver or a putter. Since the intermediate layer is very soft, the ball is spin susceptible and easy to control with a sand wedge. Additionally, the balls are highly durable.

Japanese Patent Application Nos. 10-234464 and 10-234481 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising; a solid core, an enclosure layer around the core, an intermediate layer of at least one layer around the enclosure layer, and a cover of at least one layer around the intermediate layer, said enclosure layer and said intermediate layer each have a Shore D hardness of 10 to 50, the Shore D hardness of said intermediate layer is lower than that of said enclosure layer, and wherein, said solid core has a deflection A (mm) under an applied load of 100 kg, a first spherical body consisting of said solid core and said enclosure layer has a deflection B (mm) under an applied load of 100 kg, a second spherical body consisting of said solid core, said enclosure layer and said intermediate layer has a deflection C (mm) under an applied load of 100 kg, and the ball as a whole has a deflection D (mm) under an applied load of 100 kg, said deflection values satisfy the relationship: A is from 2.5 to 7.0 mm, B is from 2.3 to 7.0 mm, C is from 2.3 to 6.5 mm, and D is from 2.3 to 6.0 mm, and $0.85 \leqq B/A \leqq 1.15$, $0.85 \leqq C/B \leqq 1.15$, and $0.7 \leqq D/C \leqq 1.0$.

2. The multi-piece solid golf ball of claim 1 wherein said cover has a Shore D hardness of 48 to 68 and a thickness of 1.0 to 3.5 mm.

3. The multi-piece solid golf ball of claim 1 wherein said enclosure layer and said intermediate layer have a total thickness of 2.0 to 5.0 mm.

4. The multi-piece solid golf ball of claim 1 wherein said enclosure layer and said intermediate layer are formed mainly of thermoplastic resins of the same type.

5. The multi-piece solid golf ball of claim 1, wherein the Shore D hardness of said intermediate layer is 5 to 30 units lower than the Shore D hardness of said enclosure layer.

6. The multi-piece solid golf ball of claim 1, wherein said enclosure layer has a thickness of 0.5 to 4.0 mm.

7. The multi-piece solid golf ball of claim 1, wherein said enclosure layer and said intermediate layer have a total thickness of 2.0 to 3.0 mm.

8. A multi-piece solid golf ball comprising; a solid core, an enclosure layer around the core, an intermediate layer of at least one layer around the enclosure layer, and a cover of at least one layer around the intermediate layer, said enclosure layer and said intermediate layer each have a Shore D hardness of 10 to 50, the Shore D hardness of said intermediate layer is lower than that of said enclosure layer, said cover is formed of a cover stock comprising a thermoplastic resin as a base component and an inorganic filler, and wherein said solid core has a deflection A (mm) under an applied load of 100 kg, a first spherical body consisting of said solid core and said enclosure layer has a deflection B (mm) under an applied load of 100 kg, a second spherical body consisting of said solid core, said enclosure layer and said intermediate layer has a deflection C (mm) under an applied load of 100 kg, and the ball as a whole has a deflection D (mm) under an applied load of 100 kg, said deflection values satisfy the relationship that A is from 2.5 to 7.0 mm, B is from 2.3 to 7.0 mm, C is from 2.3 to 6.5 mm, and D is from 2.3 to 6.0 mm, and $0.85 \leqq B/A \leqq 1.15$, $0.85 \leqq C/B \leqq 1.15$, and $0.7 \leqq D/C \leqq 1.0$.

9. The multi-piece solid golf ball of claim 8 wherein said cover has a Shore D hardness of 48 to 68 and a thickness of 1.0 to 3.5 mm.

10. The multi-piece solid golf ball of claim 8 wherein said enclosure layer and said intermediate layer have a total thickness of 2.0 to 5.0 mm.

11. The multi-piece solid golf ball of claim 8 wherein said enclosure layer and said intermediate layer are formed mainly of thermoplastic resins of the same type.

12. The multi-piece solid golf ball of claim 8 wherein the cover stock contains an ionomer resin as the base and has a specific gravity of 1.0 to 1.5.

13. The multi-piece solid golf ball of claim 8 wherein the inorganic filler is barium sulfate.

14. The multi-piece solid golf ball of claim 8, wherein the Shore D hardness of said intermediate layer is 5 to 30 units lower than the Shore D hardness of said enclosure layer.

15. The multi-piece solid golf ball of claim 8, wherein said enclosure layer has a thickness of 0.5 to 4.0 mm.

16. The multi-piece solid golf ball of claim 8, wherein said enclosure layer and said intermediate layer have a total thickness of 2.0 to 3.0 mm.

* * * * *